US009517499B2

(12) United States Patent
Marshall

(10) Patent No.: US 9,517,499 B2
(45) Date of Patent: Dec. 13, 2016

(54) S-LOCK FLASHING MEMBER FORMING APPARATUS

(71) Applicant: Joseph T. Marshall, Rathwell (CA)

(72) Inventor: Joseph T. Marshall, Rathwell (CA)

( * ) Notice: Subject to any disclaimer, the term of this patent is extended or adjusted under 35 U.S.C. 154(b) by 83 days.

(21) Appl. No.: 14/706,080

(22) Filed: May 7, 2015

(65) Prior Publication Data

US 2015/0336149 A1 Nov. 26, 2015

(30) Foreign Application Priority Data

May 23, 2014 (CA) ..... 2852327

(51) Int. Cl.
*B21D 5/16* (2006.01)
*B21D 5/01* (2006.01)
*B21D 53/00* (2006.01)

(52) U.S. Cl.
CPC . *B21D 5/16* (2013.01); *B21D 5/01* (2013.01); *B21D 53/00* (2013.01)

(58) Field of Classification Search
CPC ..... B21D 5/01; B21D 5/02; B21D 5/0209; B21D 5/16; B21D 11/20; B21D 39/02
See application file for complete search history.

(56) References Cited

U.S. PATENT DOCUMENTS 4,803,879 A 2/1989 Crawford
8,590,577 B2 * 11/2013 Borwig ..... B21C 37/101 138/157
2010/0077821 A1 * 4/2010 Borwig ..... B21D 5/04 72/127
2011/0302985 A1 * 12/2011 Miller ..... B21D 5/16 72/376

* cited by examiner

*Primary Examiner* — Debra Sullivan
(74) *Attorney, Agent, or Firm* — Ryan W. Dupuis; Kyle R. Satterthwaite; Ade & Company Inc.

(57) ABSTRACT

A forming apparatus includes a work surface and three die members movable relative to the work surface for bending a sheet metal flashing member to form an S-shaped end joint known as an S-lock or slip lock joint.

16 Claims, 13 Drawing Sheets

S-LOCK FLASHING MEMBER FORMING APPARATUS

This application claims foreign priority benefits from Canadian Patent Application 2,852,327 filed May 23, 2014.

FIELD OF THE INVENTION

The present invention relates to a forming apparatus for bending sheet metal, and more particularly the present invention relates to a forming apparatus for bending an S-shaped end joint on a flashing member, for example roof flashing members for use on a building exterior.

BACKGROUND

In the roofing industry it is common to use sheet metal flashing for sealing and finishing various roof edges. The flashing members typically comprise elongate metal sheets in varying lengths and widths which are interlocked with one another at respective ends by a slip lock or S-lock joint. The general profile of an S-lock joint is essentially a flattened S such that the sheet member forms a main portion of the flashing member, an intermediate portion folded back over top of the main portion, and a free end portion extending back across the intermediate portion in the longitudinal direction of the flashing member beyond the end of the main portion. The free end portion is typically fastened to the roof structure. A subsequent flashing member can then be inserted into the space between the end portion and the intermediate portion of the already fastened flashing member. As presently practiced in the industry, slip locks can be formed using conventional sheet metal bending equipment but the process involves many steps and is therefore very labour intensive and expensive.

U.S. Pat. No. 4,803,879 by Crawford describes a slip lock forming apparatus using two dies about which a sheet metal panel is folded for forming the S-lock joint. By using only two dies, which are forced together, the sheet metal involves some relative sliding against the surfaces of the die during the forming process which produces scratches in the finished product and provides limited control over the precise path which the sheet metal is bent to produce the S-lock joint.

SUMMARY OF THE INVENTION

According to one aspect of the invention there is provided a forming apparatus for forming an S-shaped end joint at one end of a flashing member such that the flashing member includes a main portion extending in a longitudinal direction, an intermediate portion joined to an outer end of the main portion at a first bend so as to be folded back over the main portion, and a fastener portion joined to the intermediate portion at a second bend so as to extend in the longitudinal direction beyond the outer end of the main portion in overlapping configuration with the intermediate portion, the apparatus comprising:

a frame including a work surface arranged to support the flashing member thereon;

a first die member having a first forming surface oriented transversely to the work surface and a first forming edge lying in a plane of the first forming surface;

the first die member being supported on the frame so as to be movable between an engaged position in which the first forming edge is in proximity to the work surface so as to be arranged to engage the flashing member on the work surface and a released position in which the first forming edge is spaced apart from the work surface;

a second die member having a second forming surface and a pivot edge at one end of the second forming surface, the second die member being supported such that the pivot edge is in proximity to the first forming surface in the engaged position of the first die member at a location spaced from the first forming edge along the plane of the first forming surface corresponding to a length in the longitudinal direction of the intermediate portion of the flashing member;

a third die member having a third forming surface, a fourth forming surface intersecting the third forming surface at an acute interior angle, and a second forming edge substantially at an intersection of the third and fourth forming surfaces;

the third die member being supported on the frame for a first movement corresponding to a pivotal movement about a third die pivot axis substantially at the first forming edge in the engaged position of the first die member between a first position in which the third forming surface is substantially co-planar with the work surface, and a second position in which the third forming surface is in close proximity to the first forming surface and the second forming edge is in close proximity to the intersection of the first and second die surfaces so as to be arranged to partially form the first bend about the first forming edge and partially form the second bend about the second forming edge;

the second die member being supported for pivotal movement relative to first die member about a second die pivot axis extending substantially along the pivot edge thereof in proximity to an intersection of the first and second forming surfaces from a first position in which the first forming surface and the second forming surface form an obtuse exterior angle therebetween to a second position in which the second forming surface of the second die member is pivotal about the pivot axis against the fourth forming surface of the third die member in the second position of the third die member;

the third die member being supported on the frame for a second movement from the second position thereof to a third position spaced apart from the first die member.

The arrangement of die members described above permits both the first bend to be partially formed about the first forming edge and the second bend to be partially formed about the second forming edge. Once the first and second bends are partially formed so that the flashing member forms a generally Z-shaped profile, a simple pressing operation as shown at FIG. 8 of U.S. Pat. No. 4,803,879 by Crawford can be used to press the Z-shaped flashing member into the completed and flattened S-lock end joint.

Alternatively, additional functionality may be provided to the die members of the apparatus according to the present invention to allow the die members to complete the flattening of the Z-shaped profile of partially formed bends into the finished S-lock end joint.

According to a preferred embodiment, the apparatus may be configured to flatten the Z-shaped profile of partially formed bends into the finished S-lock end joint by being further arranged such that:

i)the second forming surface of the second die member is further pivotal about the pivot axis thereof from the second position of the second die member to a third position of the second die member in which the second forming surface is against the first forming surface when the third die member is in the third position;

ii) the third die member is supported on the frame for a third movement from the third position to return to the second position; and iii) the third die member is supported on the frame for a fourth movement corresponding to a pivotal movement about a pivot axis in proximity to an intersection of the third forming surface and the work surface from the second position to a fourth position in which the third forming surface of the third die member is in close proximity to the work surface.

By providing three separate die members supported for various movements relative to a work surface as described herein, the path of the sheet metal used to form the S-lock end joint in the flashing member can be precisely controlled with minimal slippage relative to the die members. Accordingly, the process can be readily automated in the operation of the forming apparatus while producing a very accurate finished product. Furthermore, minimal slippage of the sheet metal relative to the die members avoids any unnecessary scratching of the finished product.

Preferably the apparatus further comprises a clamping member supported on the frame so as to be movable relative to the work surface so as to be arranged to clamp the flashing member to the work surface. The clamping member may be slidable generally perpendicularly to the work surface between clamping and released positions thereof.

Preferably the first die member is slidable in a direction of the first forming surface between the engaged position and the released position thereof.

In the illustrated embodiment, the first forming surface may be oriented at an upward inclination of approximately 55 degrees from the work surface.

The second die member preferably includes a rear surface which intersects the second forming surface at an acute interior angle which defines the pivot edge substantially at the second die pivot axis. The acute interior angle of the second die member in the illustrated embodiment is approximately 45 degrees.

Preferably the second die member is positionable in a first position in which the rear surface is engaged in parallel arrangement against a portion of the first die member which is co-planar with the first forming surface. The second die member may be pivotal about the second die pivot axis from a first position in which the second forming surface is transverse to the work surface to a second position in which the second forming surface is engageable in parallel arrangement against the fourth forming surface of the third die member. The second die member may be further pivotal about the second die pivot axis towards a third position in which the second forming surface is engageable in parallel arrangement against the first forming surface of the first die member.

Preferably the apparatus further comprises a carriage assembly supported on the frame and supporting the third die member thereon in which the carriage assembly is movable relative to the frame so as to define a first degree of movement of the third die member relative to the frame, and in which the third die member is movable relative to the carriage assembly so as to define a second degree of movement of the third die member relative to the frame.

Preferably the carriage assembly is pivotal relative to the frame and the third die member is pivotal about the third die pivot axis relative to the carriage assembly.

The apparatus may further include an auxiliary forming surface wherein one of the first, second, third and fourth forming surfaces is interchangeable with the auxiliary forming surface and wherein the auxiliary forming surface is different in length than said one of the first, second, third, and fourth forming surfaces. More particularly, the apparatus may further include a first auxiliary forming surface which is interchangeable with the first forming surface and which is different in length than the first forming surface and a second auxiliary forming surface which is interchangeable with the third forming surface and which is different in length than the third forming surface.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
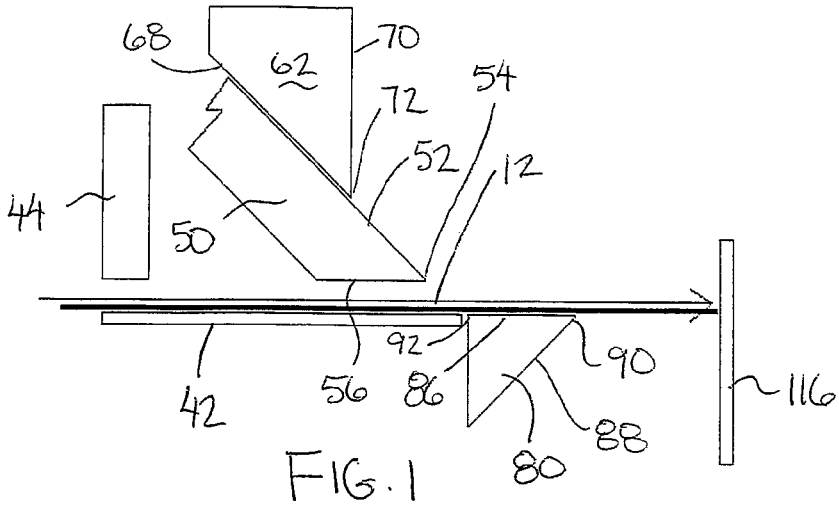
FIGS. 1 through 18 schematically represent various positions of the die members of the forming apparatus according to the present invention when used for forming an S-lock end joint in a flashing member according to a first mode of operation.

Referring to the accompanying figures, there is illustrated a forming apparatus generally indicated by reference numeral 10. The forming apparatus is particularly suited for forming an S lock end joint in a flashing member formed of sheet metal.

More particularly, the forming apparatus bends the flashing member 12 such that the resulting flashing member includes a generally planar main portion 14 terminating at an outer end forming a first bend 16. The first bend 16 is an approximately 180 degree fold between the longitudinal direction of the main portion 14 and a generally planar intermediate portion 18 which is folded back alongside the main portion 14 from the first bend 16 at one edge to a second bend 20 at the opposing edge of the intermediate portion. At the second bend 20, the sheet metal is again folded through 180 degrees such that the remaining end portion of the flashing member defines a fastener portion 22 extending alongside the intermediate portion to extend in the longitudinal direction of the main portion 14 beyond the outer end of the main portion locating the first bend 16.

The apparatus 10 generally includes a main frame 30 which includes two side portions 32 which are upright and parallel to one another at laterally opposed sides of the frame. The two side portions 32 each define a pair of legs thereon such that the overall frame is supported on four legs at four respective corners thereof. A pair of horizontal lower braces 34 span horizontally between a front pair and a rear pair of the legs of the two side portions 32 respectively.

In addition to being joined by the lower braces 34, the two side portions 32 are also joined by a rear brace 36 joined between the two side portions 32 at the rear side at an intermediate height in proximity to the top end of the frame. A front brace 38 is joined between the two side portions 32 at the top end of the frame in proximity to the front side. An intermediate brace 40 is fixed between the two side portions at the top side above the rear brace 36 and spaced slightly forwardly therefrom while remaining approximate to the rear side of the frame. The rear brace 36 and the intermediate brace 40 are mounted to the side portions of the frame to permit some relative adjustment therebetween as each of the braces serves to support additional operating components of the forming apparatus as described in further detail below.

The frame 30 further includes a work surface 42 spanning horizontally between the two side portions 32 at an intermediate height below the rear brace, the intermediate brace or the front brace. The work surface 42 defines a planar surface on the top side thereof upon which a flashing member can be supported by inserting the end upon which the end joint is to be formed through the rear side of the frame.

The apparatus 10 further includes a clamping member 44 in the form of an elongate bar spanning laterally between the two side portions 32. The laterally opposing ends of the two side portions 32 are supported for vertical sliding within respective slots in the two side portions 32. The clamping member 44 includes a bottom edge which is moveable from a released position spaced above the work surface to a clamping position clamped against the work surface so as to be suitably arranged for clamping a flashing member against the work surface.

The clamping member 44 is supported directly below the rear brace 36 within a common vertical plane. Each of the opposing ends of the clamping member 44 is connected by a pair of links 46 to the rear brace 36 thereabove such that each pair of links is movable from a folded position in the released position of the clamping member to a straight aligned position vertically oriented between the rear brace and the clamping member in the clamped position thereof. An air cylinder 48 includes an actuator arm which is oriented for horizontal linear movement and which is coupled to the central hinge of each pair of links 46 such that extension and retraction of the air cylinder displaces the links from the folded condition to the straight condition for actuating the clamping of the clamping member.

The apparatus 10 further includes a first die member 50 in the form of a rigid planar body oriented at an angle of approximately 55 degrees from the work surface to extend upwardly rearwardly from the work surface. The forward and upward facing surface of the planar body of the first die member defines a first forming surface 52 which terminates at a bottom edge spanning laterally between the two side portions of the frame and defining a first forming edge 54 of the first die member. The first forming edge 54 defines the lowermost portion of the first die member and lies in a common plane with the first forming surface 52.

The first die member 50 may further include a bottom surface 56 oriented at an interior angle with the first forming surface 52 corresponding to approximately 55 degrees such that the bottom surface is parallel to the work surface and such that the first forming edge 54 is formed at the intersection of the bottom surface and the first forming surface.

The first die member 50 is supported for sliding movement within the plane of the planar body so as to be slidable parallel to the first forming surface from an engaged position to a released position. Laterally opposing ends of the first die member are mounted in sliding configuration on respective ones of the side portions of the frame between the engaged and released positions. In the engaged position, the first forming edge is in proximity to the work surface so as to be arranged to engage and clamp the flashing member against the work surface. In the released position, the first die member is displaced upwardly and rearwardly from the engaged position such that the first forming edge is spaced apart from the work surface.

Displacement of the first die member between the engaged and released positions is accomplished by two pairs of actuator links 58 which function similarly to the links 46 of the clamping member. The intermediate brace 40 in this instance comprises a planar body lying substantially in a common plane with the first die member at a location spaced upwardly and rearwardly therefrom. Each pair of links 58 is coupled between the intermediate brace and a respective one of the two laterally opposed ends of the first die member in proximity to the two side portions of the frame respectively. The links 58 are foldable relative to one another between a folded condition corresponding to the disengaged or released position of the first die member, and a straight condition in which the links lie along a common axis corresponding to the direction of movement of the first die member when in the engaged position of the first die member. An air cylinder 60 is associated with each pair of links and includes an actuator arm which is horizontally slidable and which is coupled to the pivot of the respective pair of links to actuate the first die member between the engaged and released position with extension and retraction of the respective actuators 60.

When in the engaged position, the first forming edge 54 clamped against the flashing member on the work surface defines the location of the first bend 16 about which the sheet metal is bent when forming the end joint as described in further detail below.

The forming apparatus 10 further includes a second die member 62 which is also mounted to span laterally across the frame between the two side portions of the frame respectively. More particularly, the second die member 62 is supported to span across the first forming surface of the first die member. The two opposing ends of the second die member 62 are supported on a pair of wheel bodies 64 respectively in which the wheel bodies are pivotally supported about a common horizontal axis relative to the first die member and main frame by a pair of support brackets 66 which are mounted on laterally opposing ends of the supporting body of the first die member. The support brackets 66 are adjustable relative to the first die member for calibrating alignment of the pivotal movement of the second die member relative to the first die member and the work surface.

The second die member includes a rear face 68 which is generally planar and which is initially positioned flat against the first forming surface of the first die member in a first position of the second die member as described in further detail below.

In the first position, the second die member 62 further includes a front surface 70 which is generally upright and forward facing in the first position. The front and rear faces taper downwardly and inwardly towards one another in the first position of the second die member so as to intersect one another at a bottom edge 72 of the second die member corresponding to an interior angle of approximately 45 degrees. The bottom edge is horizontally oriented and spans laterally between the two side portions of the frame. The front face of the second die member defines a second forming surface 70 of the overall forming apparatus upon which the sheet metal of the flashing member is engaged during the forming process. The second forming surface 70 terminates along one edge at the bottom edge 72 of the second die member.

The second die member is supported such that the bottom edge 72 is substantially in abutment with the first forming surface of the first die member at a location which is parallel and spaced upwardly and rearwardly along the plane of the first forming surface from the first forming edge of the first die member by a distance corresponding to the longitudinal length of the intermediate portion of the resulting flashing member. The bottom edge 72 of the second die member also substantially defines a second die pivot axis about which the second die member is pivotal relative to the first die member and the work surface respectively. The second die pivot axis thus lies substantially at the intersection of the first forming surface on the first die member and the second forming surface on the second die member.

The second die member is supported for pivotal movement, about the second die pivot axis, forwardly and generally downwardly from the first position described above towards an intermediate second position and a subsequent third position as described in further detail below. In the first position, the first forming surface and the second forming surface form an exterior angle therebetween of approximately 135 degrees when the first and second die members are abutted with one another.

The second die member is entirely supported on the first die member for movement therewith relative to the work surface between the engaged position and the released position. This is accomplished by the two support brackets 66 which support each of the two wheel bodies 64 rotatably on respective laterally opposed ends of the first die member at respective portions of the first die member protruding laterally outward beyond the two side portions of the frame.

The first die member also fixedly supports two actuator mounts 74 on the top and forward facing surface of the supporting body of the die member spaced above the lower portion of the die member that defines the first forming surface thereon. The two actuator mounts 74 are laterally spaced apart for pivotally connecting the first end of a respective pair of actuators 76 thereon. The actuators 76 comprise linear actuators having opposing ends which are pivotally coupled to respective lugs 78 on the second die member. In this manner, extension of the actuators 76 causes the lugs 78 to be displaced downwardly and forwardly, thus pivoting the die member from the first position towards the respective second and third positions thereof about the second die pivot axis defined by the two wheel bodies 64 pivotally supported on the support brackets 66 which in turn are carried on the first die member.

The apparatus 10 further includes a third die member 80 supported on the frame for various movements as described in further detail below. More particularly, the apparatus 10 includes a carriage assembly 82 comprising a moveable frame which is moveable relative to the main frame at a bottom end thereof in a generally horizontal direction which is forward or rearward relative to the direction of the main frame. The third die member 80 is in turn pivotally supported on the carriage assembly 82 such that the third die member 80 is supported for various combinations of pivotal movement about a horizontal axis spanning laterally between the two side portions and translating movement in the generally forward and rearward directions of the frame.

The third die member 80 has a main body 84 which includes a first planar face defining a third forming surface 86 of the apparatus and a second planar face defining a fourth forming surface 88 of the forming apparatus. The third and fourth forming surfaces intersect one another at an acute interior angle of the approximately 35 degrees such that the corresponding edge defines a second forming edge 90 of the overall forming apparatus.

The third forming surface spans between the second forming edge 90 and an opposing end edge 92 such that the overall length between the second forming edge and the end edge is approximately equal to the overall length of the intermediate portion of the flashing member between the first and second bends thereof. More particularly, the third die member may be positioned with the end edge 92 in proximity to the work surface such that the third forming surface spans parallel and alongside the first forming surface of the first die member with the second forming edge 90 terminating in proximity to the intersection of the first and second forming surfaces for forming the second bend in the sheet metal therebetween.

The carriage assembly 82 generally includes a horizontal pivot shaft 94 spanning laterally and horizontally between the two side portions of the frame substantially directly vertically above the pivot axis of the second die member in the engaged position of the first die member so as to be substantially in a common vertical plane therewith. Two side arms 96 extend downwardly from opposing ends of the pivot shaft 94 in proximity to the opposing side portions of the frame in which the side arms are fixed to the pivot shaft for pivotal movement together therewith. This results in the bottom end of the side arms, and the bottom end of the carriage assembly, being displaced forwardly and rearwardly in a substantially horizontal translation with the pivoting movement of the side arms about the horizontal axis of the pivot shaft 94.

A pair of wheel members 98 are pivotally supported on the bottom ends of respective ones of the two side arms 96 such that the wheel members 98 are pivotal about a common axis extending horizontally between the bottom ends of the arms. The third die member is mounted such that laterally opposed ends of the third die member are fixed onto the two wheel members 98 respectively with the pivotal movement of the wheel members relative to the carriage assembly 82 defining the pivot axis of the third die member. The third die member pivot axis lies substantially at the intersection of the first and third forming surfaces and also substantially at the first forming edge at the vertically centered position of the carriage assembly.

The horizontal translation of the bottom end of the carriage assembly is controlled by two pairs of links 100 coupled between the two side arms 96 at the bottom ends thereof and respective brackets 102 on the two side portions of the frame respectively. The brackets 102 are readily adjustable relative to the frame as well as providing adjustment for the mounting of the respective links thereon for calibration of the carriage assembly movement relative to the main frame. Each pair of links is pivotal or foldable between a folded condition in which the bottom end of the carriage assembly is displaced away from the front edge of the work surface in proximity to the front first forming edge of the first die member, and a straight condition in which the pivot axis of the third die member is in a common vertical frame with the pivot axis of the carriage assembly. An actuator 104 is associated with each pair of links in which a linearly extendable actuator arm of each actuator is connected to the central pivot of the respective pair of links so that vertical extension and retraction of the actuator results in displacement of the respective pair of links from a folded condition to a straight condition extending horizontally between the side arms 96 and the respective brackets 102.

Pivoting of the third die member relative to the carriage assembly and the frame upon which it is supported is controlled by controlling rotation of one of the wheel members 98. A first gear 106 rotates with the respective wheel member 98 about the pivot axis of the third die member while an opposing second gear 108 is supported for rotation about the pivot shaft 94 of the carriage assembly such that the axes of rotation of the first and second gears remain parallel to one another and spaced apart from one another by the same distance throughout the swinging movement of the carriage assembly.

A linear actuator 110 is mounted on the carriage assembly such that an output arm of the vertical actuator is coupled by a lug 112 to a link of a chain 114 spanning in an endless loop about the first and second gears. The chain is in meshing engagement with the first and second gears. Linear displacing of an upright length of the chain spanning between the first and second gears causes the first and second gears to rotate which in turn causes a controlled rotation of the respective wheel member 98 and the third die member 80 supported thereon. The gearing arrangement of the chain is arranged such that the linear extension range of the actuator 110 corresponds to a pivotal rotation of the third die member through a range of approximately 180 degrees.

In this manner, the third die member is supported for a first movement corresponding to a pivotal movement about the third die pivot axis substantially at the first forming edge in the engaged position of the first die member from a first position to a second position. In the first position, the third forming surface is substantially coplanar with the work surface. In the second position, the third forming surface is in close proximity to the first forming surface and the second forming edge is in close proximity to the intersection of the first and second die surfaces so as to be arranged to partially form the first bend 16 about the first forming edge and partially form the second bend 20 about the second forming edge during the first movement of the third die member.

The third die member is further supported for a second movement from the second position noted above to a third position. In the second position, the second forming surface of the second die member is pivotal about the pivot axis against the fourth forming surface of the third die member. In the third position, the third die member is spaced apart from the first die member such that the second forming surface of the second die member can be further pivoted about the second die pivot axis thereof against the first forming surface of the first die member.

The third die member is further supported for a third movement from the third position to return to the second position for additional forming steps. Finally, the third die member is supported for a fourth movement corresponding to a pivotal movement about the third die pivot axis in proximity to an intersection of the third forming surface and the work surface from the second position to a fourth position. In the fourth position, the third forming surface of the third die member is in close proximity to the work surface. The final movement of the third die member involves returning to the first position.

In further embodiments, the clamping member 44 may be positioned more forwardly along the work surface 42, towards the die members 50, 62, and 80, than that shown in FIGS. 20 to 24. The positioning of the clamping member 44 closer to the die members 50, 62, and 80 may reduce the likelihood of any buckling of an intermediate portion of the sheet metal flashing member between the engagement of the flashing member with the clamping member 44 and the engagement of the flashing member with the die members 50, 62 and 80.

According to a preferred mode of operation as shown in FIGS. 1 through 19, use of the apparatus 10 initially begins with positioning of the various die members as shown in FIG. 1. In this instance, the clamping member 44 is released, the first die member 50 is in the released position, the second die member 62 is in the first position relative to the first die member, and the third die member 80 is the respective first position thereof. An additional stop member 116 can be carried on the frame which serves as an abutment surface against which the unbent flashing member can be abutted at the free end thereof prior to formation of the S lock joint.

Figure 2:
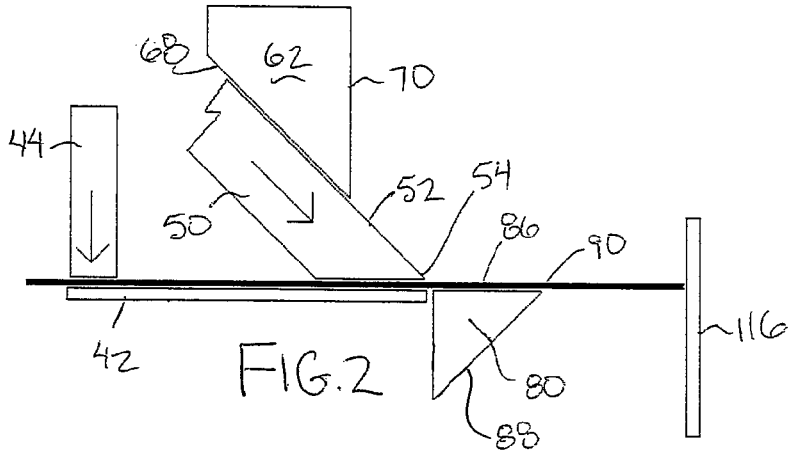
Figure 3:
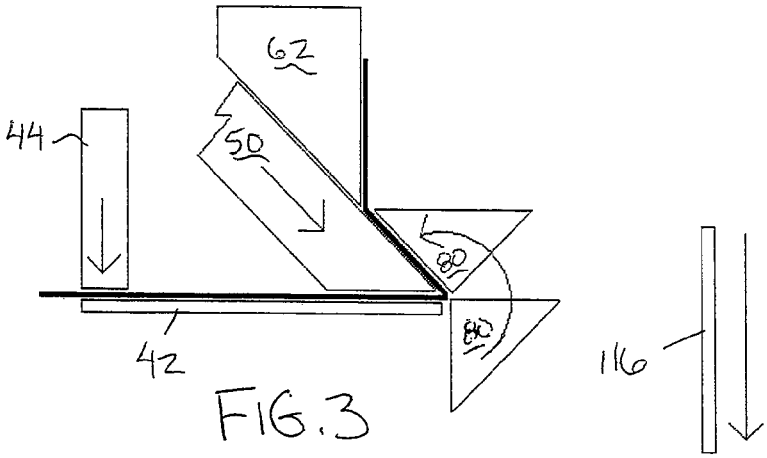

Initially, the clamp member is clamped downward against the flashing member and the first die member is displaced to the engaged position to further assist in clamping the flashing member against the work surface as shown in FIG. 2. At this point, the third die member can be pivoted about the third die pivot axis from the first position of FIG. 3 to the second position of FIG. 4 corresponding to the first movement described above. In this instance, the sheet metal is bent about the first forming edge to partially form the first bend in the flashing member while the second forming edge of the third die member partially forms the second bend against the intersection of the first and second forming surfaces of the first and second die members respectively.

Figure 4:
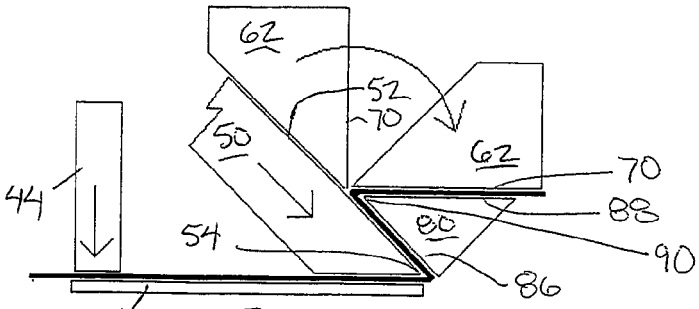

As shown in FIG. 4, with the third die member remaining in the second position, the second die member can be pivoted from the first position to the second position thereof in which the second forming surface of the second die member is pivoted parallel and against the fourth die surface of the third die member to further form the second bend in the flashing member.

Figure 5:
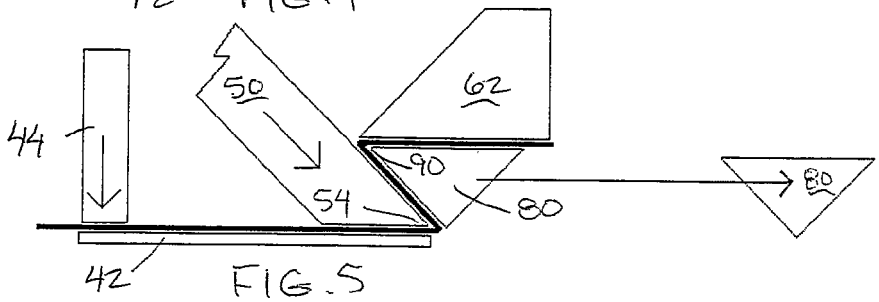
Figure 6:
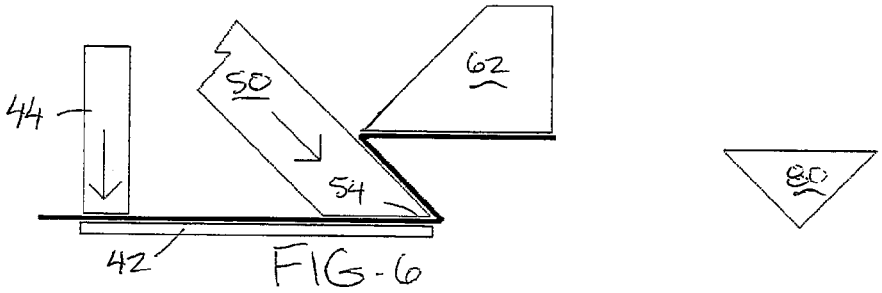
Figure 7:
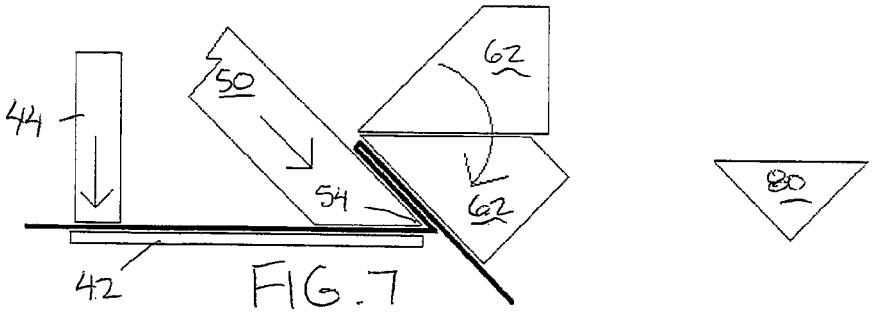

As shown in FIG. 5, the second movement of the third die member from the second position to the third position thereof then enables the second die member to be pivoted from the second position of FIG. 6 to the third position of FIG. 7.

Figure 8:
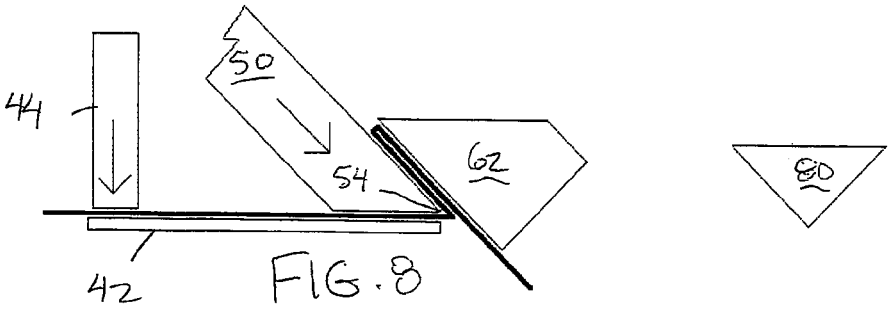
Figure 9:
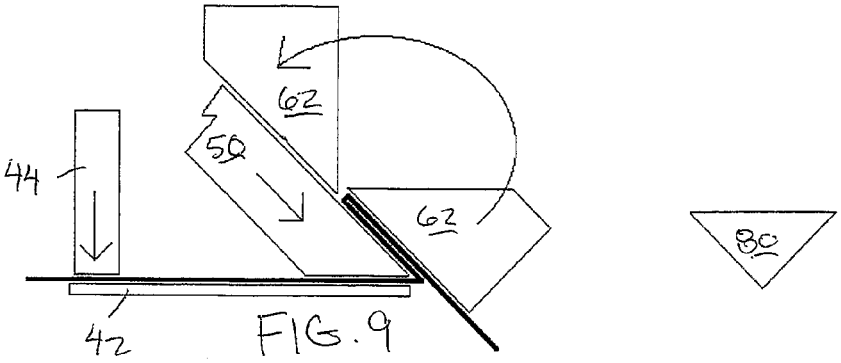
Figure 10:
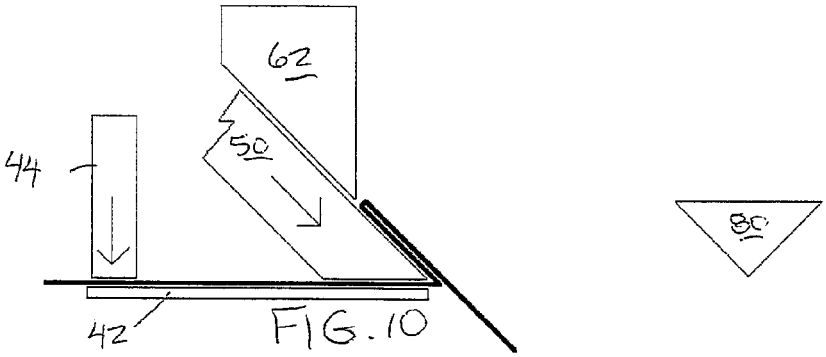
Figure 11:
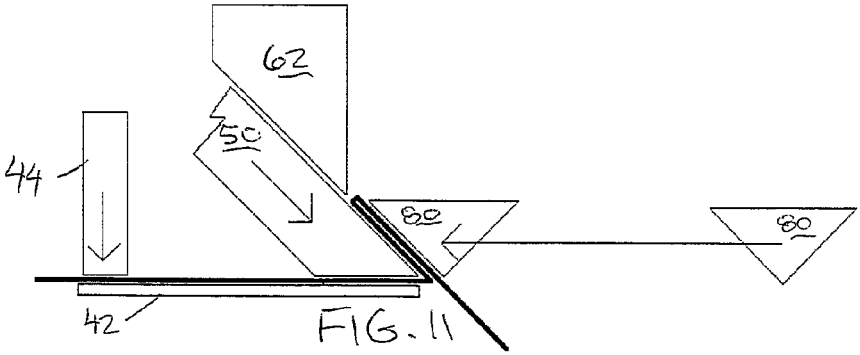

In the third position of FIGS. 7 and 8, the second bend is completed by folding the second forming surface of the second die member flat against the first forming surface of the first die member. The second die member can then be returned to its starting first position as shown in FIG. 9. The third die member can then be returned from the third position shown in FIG. 10 to the second position shown in FIG. 11 corresponding to the third movement of the third die member.

Figure 12:
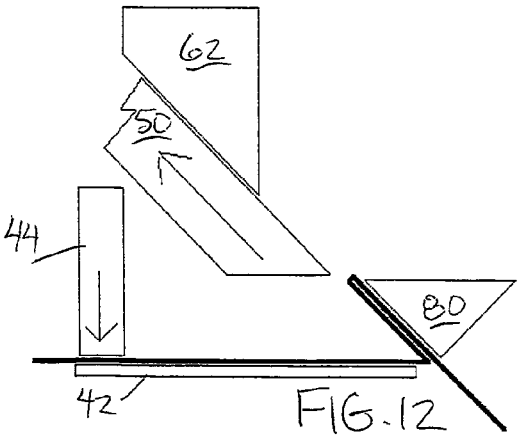
Figure 13:
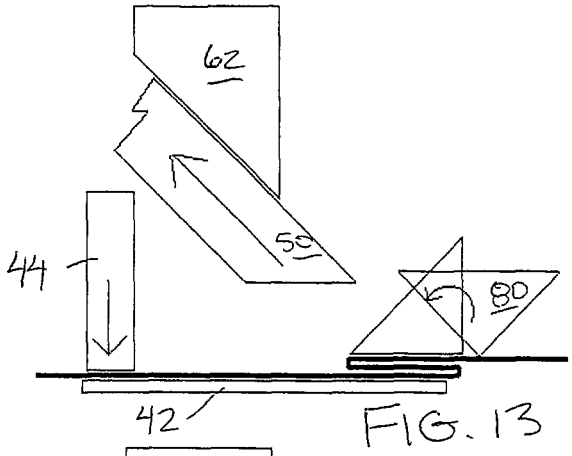
Figure 14:
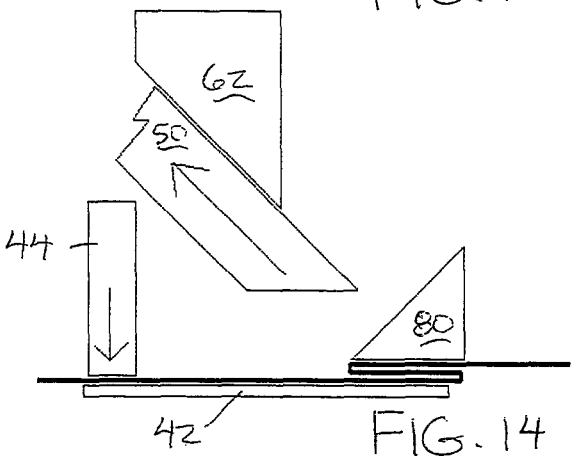

As shown in FIG. 12, the first and second die members are then slidably displaced upwardly and rearwardly to the released position thereof such that the third die member can be pivoted from the second position of FIG. 12 to the third position of FIGS. 13 and 14 corresponding to the fourth movement of the third die member as described above. This pivotal movement serves to complete the first bend by pivoting the third forming surface of the third die member against the work surface.

Figure 15:
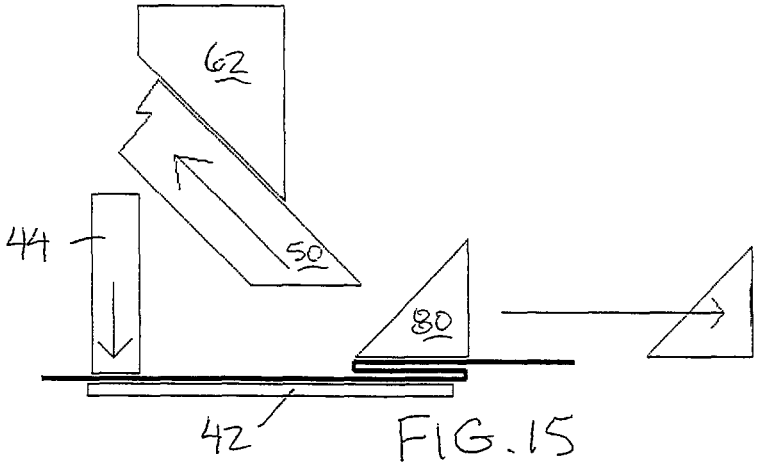
Figure 16:
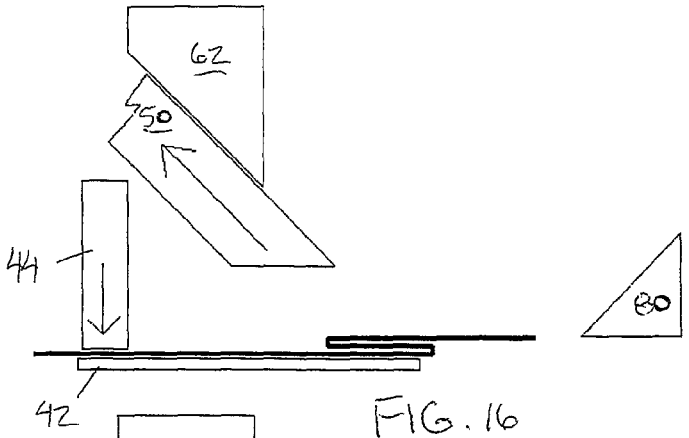
Figure 17:
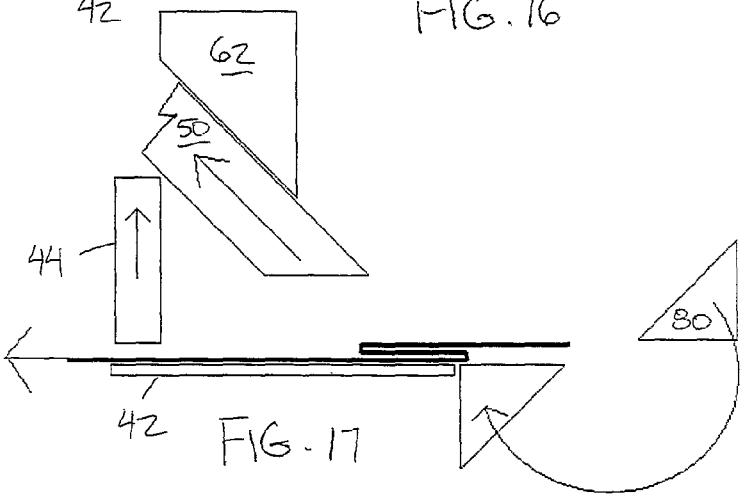
Figure 18:
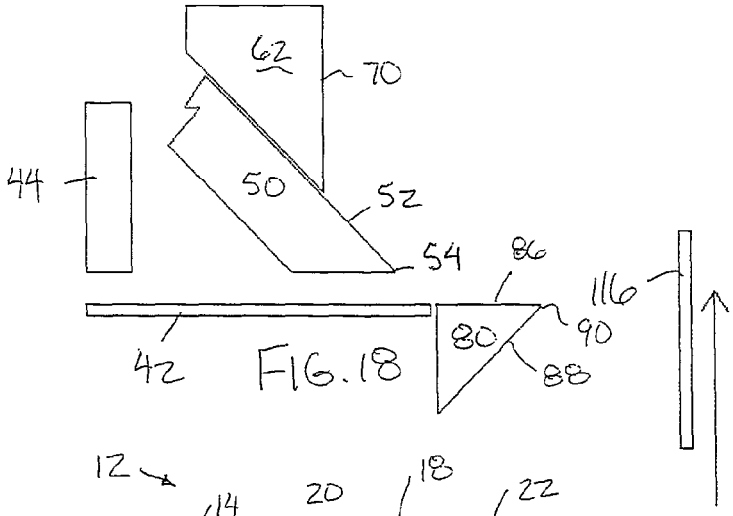

A subsequent fifth movement of the third die member returns it to its starting position by initially horizontally translating the die member forwardly by pivoting the carriage assembly, followed by pivoting of the die member relative to the carriage assembly to return the third die member to the first position relative to the carriage member, followed by returning the carriage member to its centered and vertical position as shown in FIGS. 15 through 17. A formed flashing member can then be readily removed from the forming apparatus.

Typically, the stop member 116 is vertically displaced downwardly from its active position in FIG. 1 as a stop member for the flashing member to a stored position below the work surface. Upon completion of the folding steps in FIG. 17, the stop member 116 can be vertically displaced upwardly into its working position so as to be suitably positioned for ready abutment of a new flashing member to be formed against the inner surface thereof.

Figure 19:
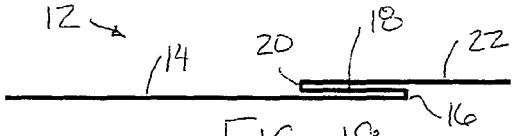
FIG. 19 is a schematic representation of a finished S-lock end joint on a flashing member subsequent to the process represented in FIGS. 1 through 18.
Figure 20:
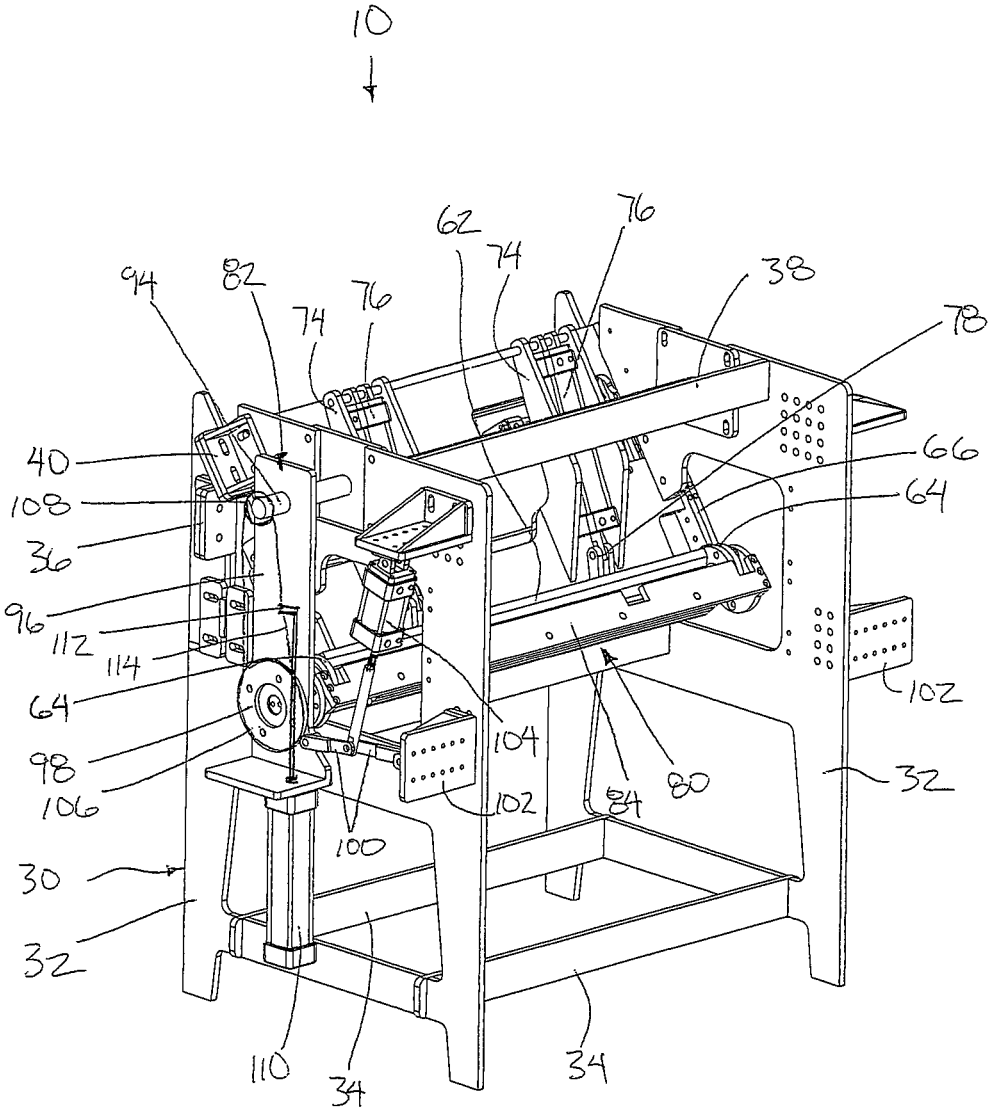
FIG. 20 is a perspective view of a front side of the forming apparatus, in which some components have been removed for simplicity.
Figure 21:
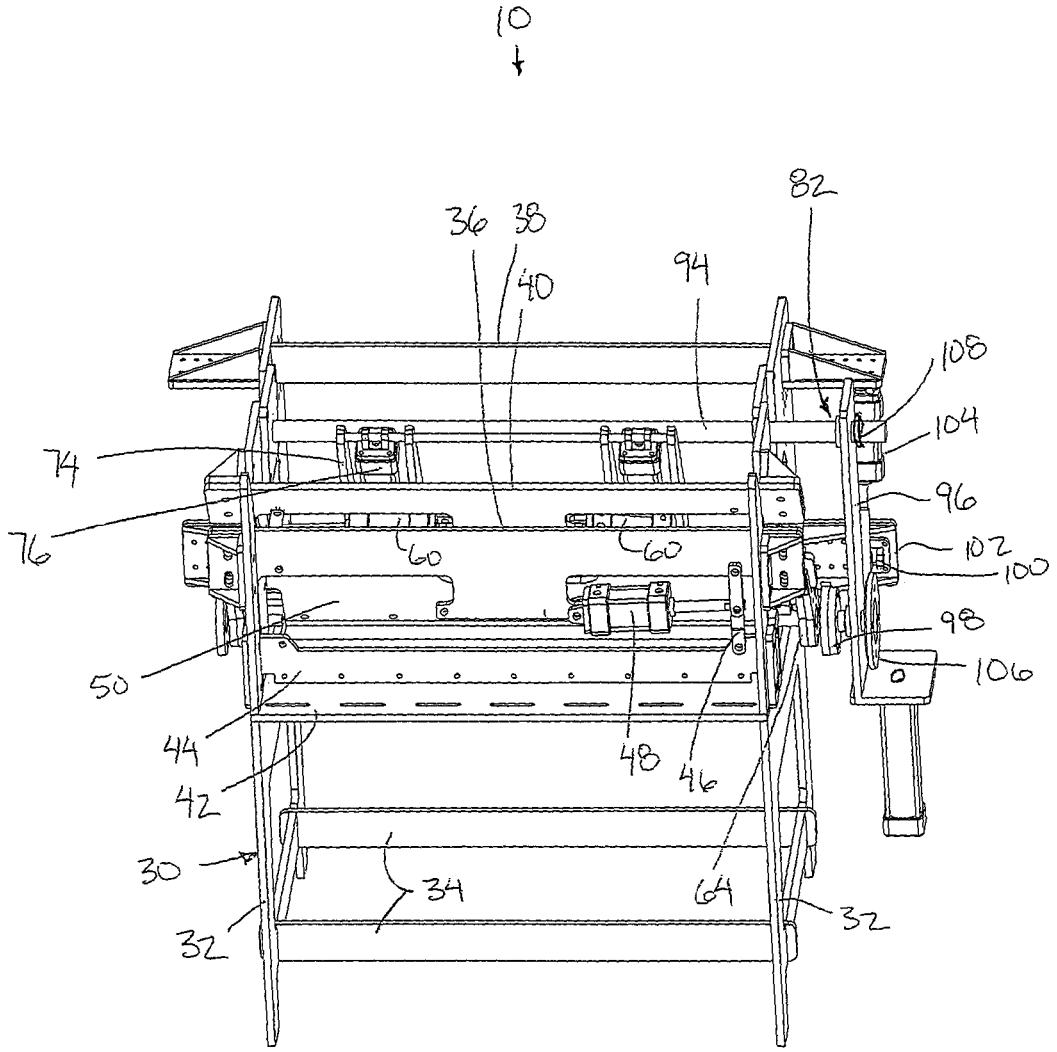
FIG. 21 is a perspective view of a rear side of the forming apparatus according to FIG. 20.
Figure 22:
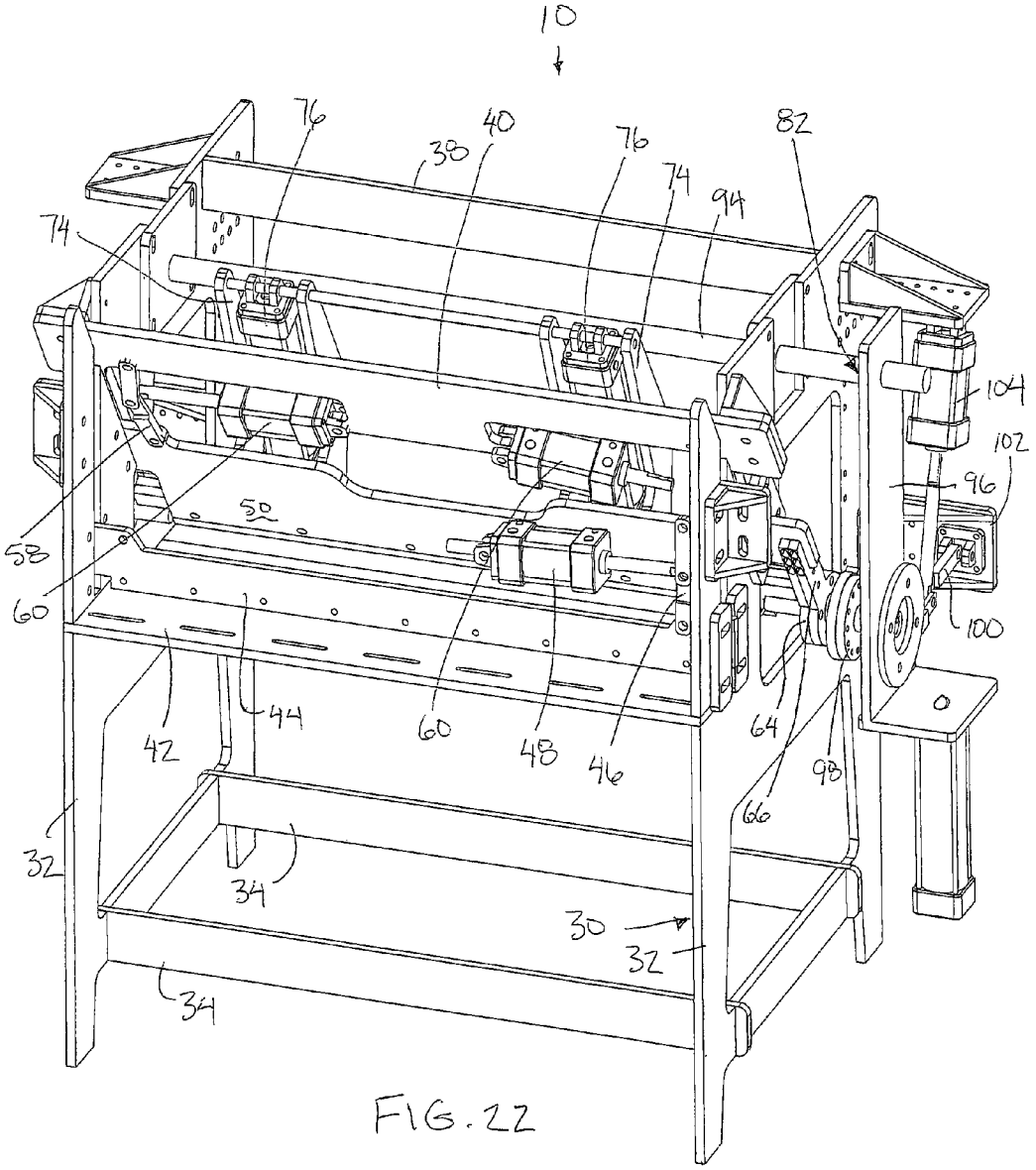
FIG. 22 is another perspective view of the rear side of the forming apparatus, in which a rear brace of the frame is shown removed for clarity.
Figure 23:
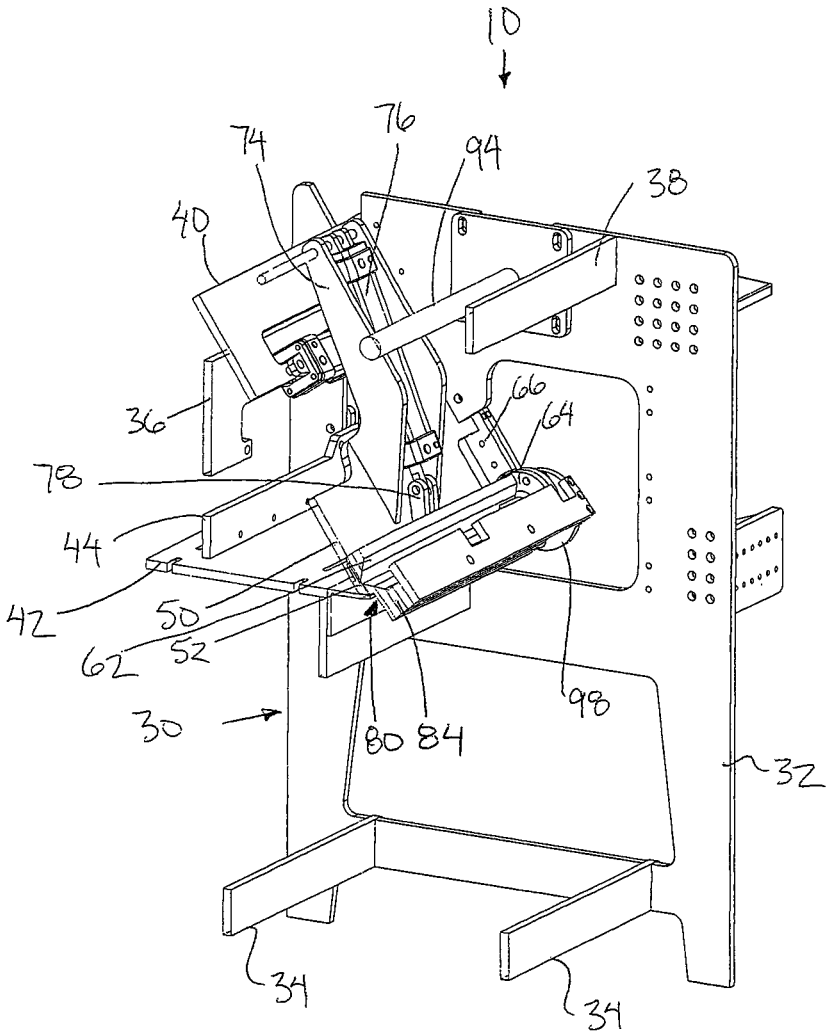
FIG. 23 is a partly sectional perspective view of the forming apparatus in which the cutting plane is oriented perpendicularly to the pivot axes of the various die members.
Figure 24:
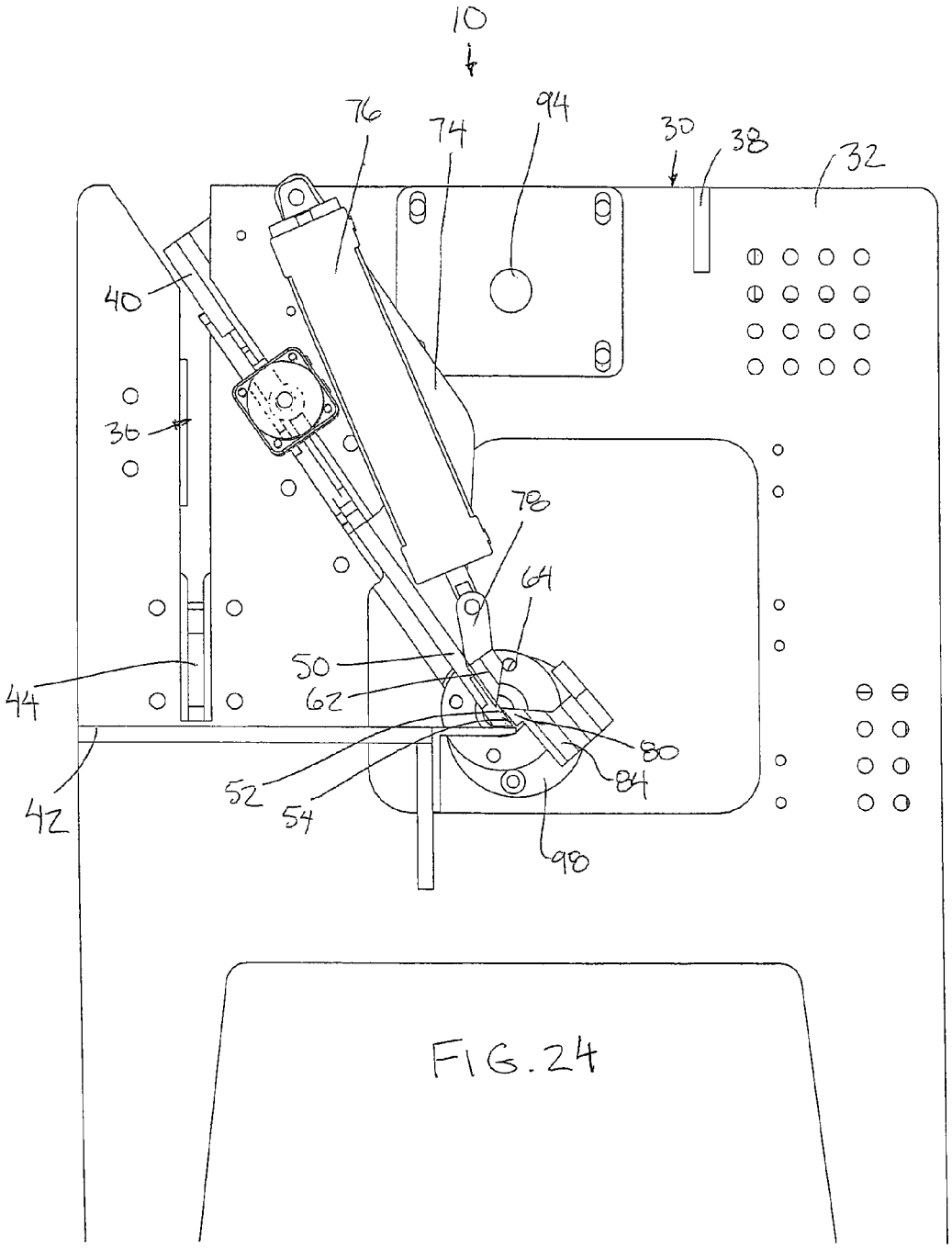
FIG. 24 is a partly sectional elevational view of the forming apparatus according to the cutting plane of FIG. 23.
Figure 25:
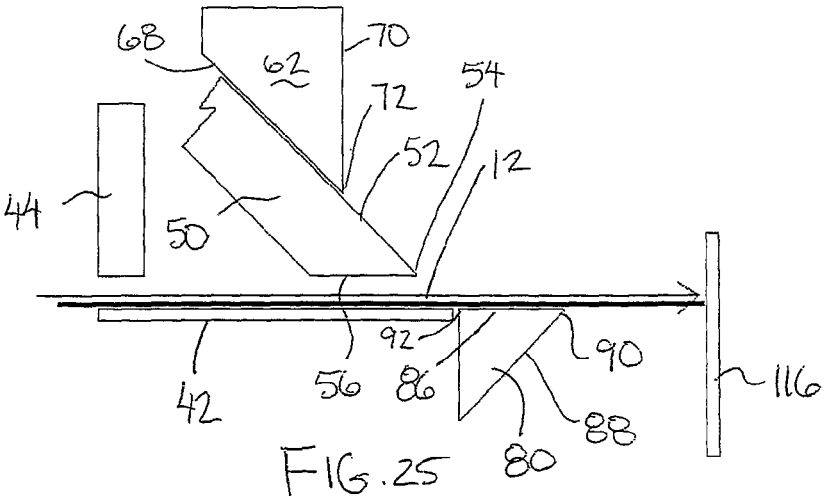
FIGS. 25 to 31 schematically represent various positions of the die members of the forming apparatus according to the present invention when used for forming an S-lock end joint in a flashing member according to a second mode of operation.
Figure 26:
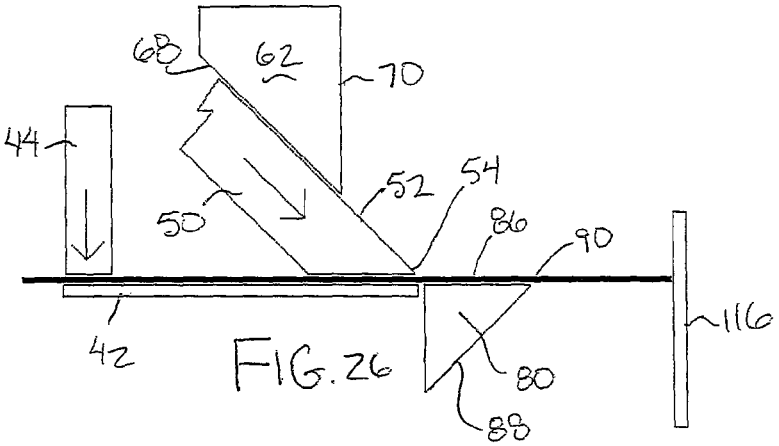
Figure 27:
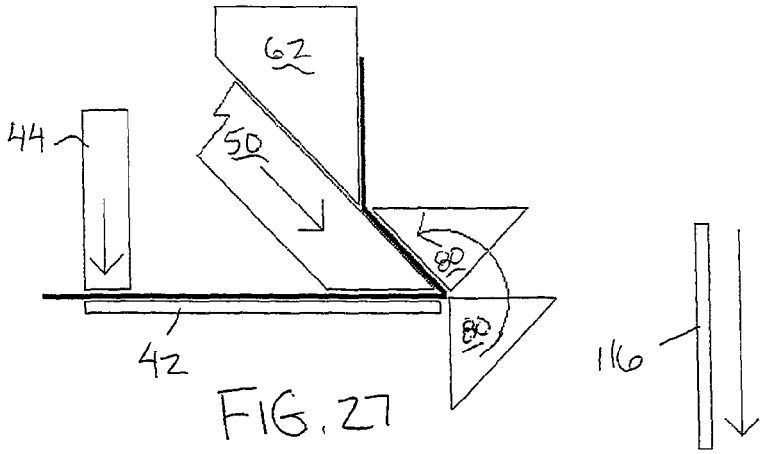

The finished flashing member with an S-lock and joint form therein is shown in FIG. 19.

As described above, the length of the intermediate portion 18 of the flashing member is determined by the length of the third forming surface 86 on the third die member from the edge 90 to the opposing edge thereof, as well as the length of the first forming surface 52 from the edge 54 to the edge 72 of the second die member abutting therewith. To adjust the length, all or a portion of each of the first and third die members may be interchanged with auxiliary die member portions which have different lengths to define a new length of the intermediate portion 18 being formed. More particularly, the apparatus can include one or more first interchangeable members and one or more second interchangeable members. The first interchangeable member defines a first auxiliary forming surface which is interchangeable with the first forming surface 52 and which is different in length than the first forming surface. Similarly, the second interchangeable member defines a second auxiliary forming surface which is interchangeable with the third forming surface and which is different in length than the third forming surface. Changing the length of the first forming surface to a longer first forming surface results in the second die member carried on the first die member being positioned farther from the work surface 42 in the engaged position of the first die member. This arrangement further results in automatically relocating both the position of the second die member and the pivot axis of the second die member defined by the wheel bodies 64 due to the second die member and actuation thereof being supported on the first die member.

Figure 28:
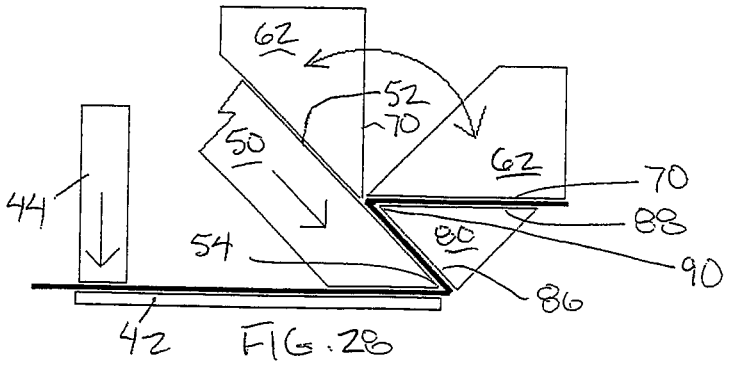
Figure 29:
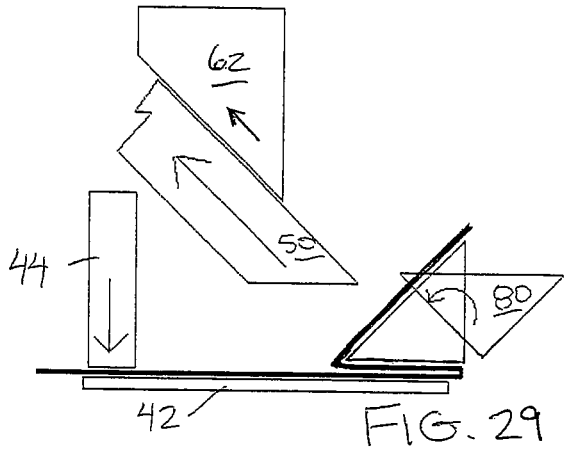

Turning now to FIGS. 25 through 31, a further mode of operation of the apparatus 10 will now be described. FIGS. 25 through 28 correspond substantially to FIGS. 1 through 4 according to the first mode of operation by pivoting the third die member against the first die member to partially form the first and second bends in the flashing member. Pivoting the second die member from the first position to the second position against the third die member as shown in FIG. 28 produces a Z-shaped profile in which the end portion of the flashing member is parallel and spaced apart from the main portion of the flashing member. The second mode of operation differs from the first mode at FIG. 29 by removing the first die to a disengaged position spaced above the work surface which permits the third die member 80 to be pivoted from the second position of FIG. 28 to the fourth position similar to the step of FIG. 13 of the first mode. In this manner, the third forming surface of the third die member is pressed against the work surface to complete the first bend in the flashing member.

Figure 30:
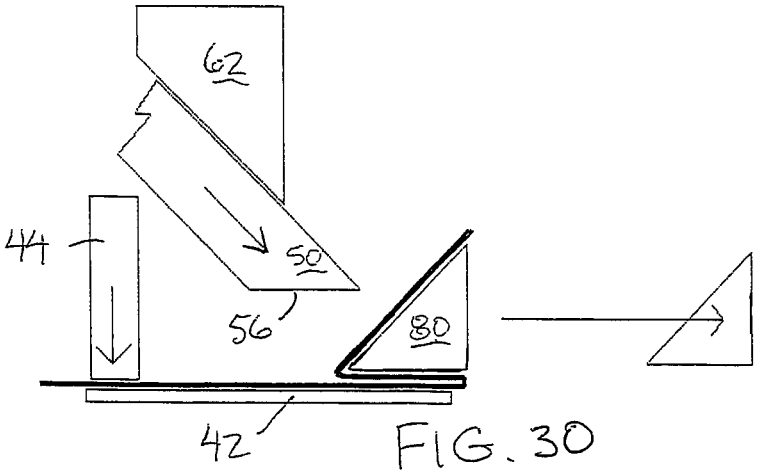
Figure 31:
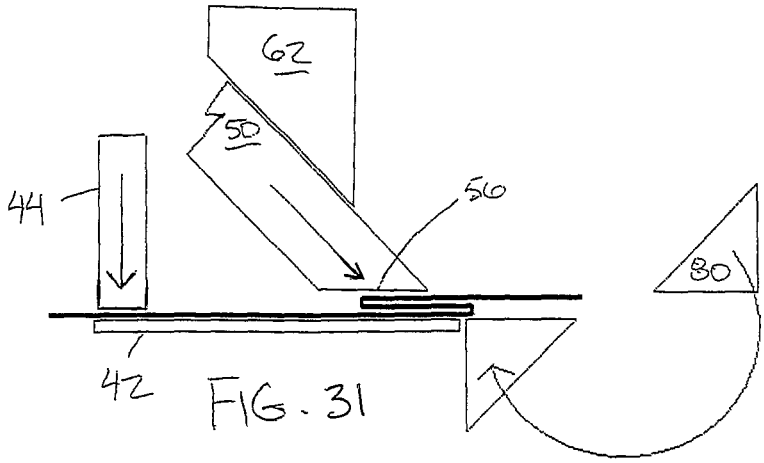

At the step of FIG. 30, the third die member is then moved away from the flashing member into the spaced apart third position thereof. This enables the first die member 50 to be returned into an engaged position clamping the flashing member against the work surface. The bottom forming surface 56 of the first die member presses against the end portion of the flashing member to complete the second bend by fully flattening the Z-shaped profile of FIG. 28 into the finished S-Lock end joint shown in FIG. 31. The third die member can then be returned to its starting position and the clamping member 44 can be raised with the first die member to release the flashing member from the apparatus.

Optionally, the clamping member 44 can also be raised, to allow repositioning of the S-lock end joint between the clamping member and the work surface 42. The clamping member 44 can then be used as a further pressing operation to further flatten the S-lock end joint.

Figure 32:
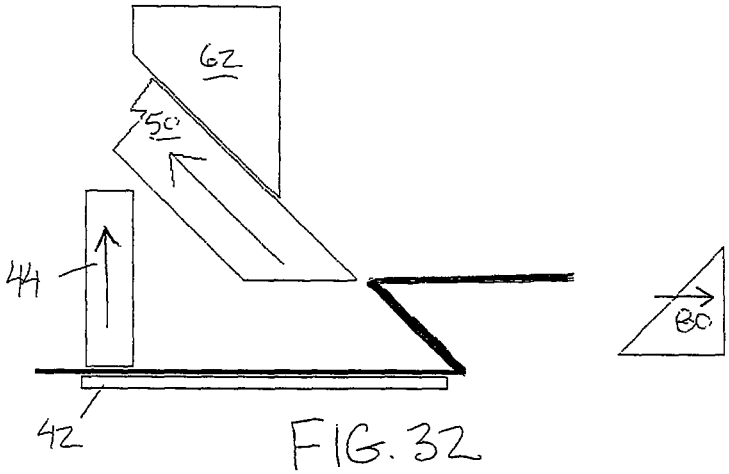
FIGS. 32 and 33 schematically represent various positions of the die members of the forming apparatus according to the present invention when used for forming an S-lock end joint in a flashing member according to the final steps of a third mode of operation.
Figure 33:
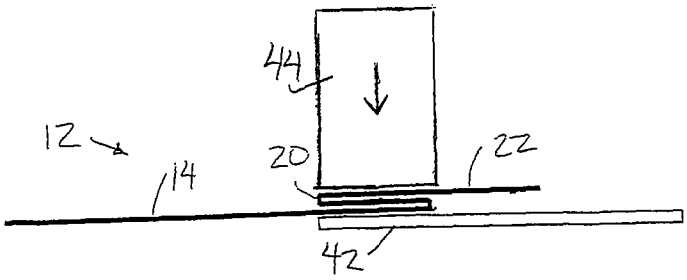

In yet a further mode of operation of the apparatus, shown in FIGS. 32 and 33, the flashing member is again shaped into a Z-shaped profile of a partially formed first bend and a partially formed second bend according to the steps of FIGS. 1 through 4 or FIGS. 25 through 28 respectively. Once the position of FIG. 4 or FIG. 28 is reached, all of the die members are returned to disengaged positions from the flashing member as shown in FIG. 32. The clamping member 44 can also be raised to permit the Z-shaped profile to be received between the work surface 42 and the clamping member 44. Lowering the clamping member again then serves to simultaneously complete both of the first and second bends by flattening the Z-shaped profile into the finished S Lock end joint in a single step.

In yet further embodiments in a separate auxiliary pressing member or die member with a flat bottom forming surface parallel to the work surface can be used to flatten the Z-shaped profile into the finished S Lock end joint as desired.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A forming apparatus for forming an S-shaped end joint at one end of a flashing member such that the flashing member includes a main portion extending in a longitudinal direction, an intermediate portion joined to an outer end of the main portion at a first bend so as to be folded back over the main portion, and a fastener portion joined to the intermediate portion at a second bend so as to extend in the longitudinal direction beyond the outer end of the main portion in overlapping configuration with the intermediate portion, the apparatus comprising:

a frame including a work surface arranged to support the flashing member thereon;

a first die member having a first forming surface oriented transversely to the work surface and a first forming edge lying in a plane of the first forming surface;

the first die member being supported on the frame so as to be movable between an engaged position in which the first forming edge is in proximity to the work surface so as to be arranged to engage the flashing member on the work surface and a released position in which the first forming edge is spaced apart from the work surface;

a second die member having a second forming surface and a pivot edge at one end of the second forming surface, the second die member being supported such that the pivot edge is in proximity to the first forming surface in the engaged position of the first die member at a location spaced from the first forming edge along the plane of the first forming surface corresponding to a length in the longitudinal direction of the intermediate portion of the flashing member;

a third die member having a third forming surface, a fourth forming surface intersecting the third forming surface at an acute interior angle, and a second forming edge substantially at an intersection of the third and fourth forming surfaces;

the third die member being supported on the frame for a first movement corresponding to a pivotal movement about a third die pivot axis substantially at the first forming edge in the engaged position of the first die member between a first position in which the third forming surface is substantially co-planar with the work surface, and a second position in which the third forming surface is in close proximity to the first forming surface and the second forming edge is in close proximity to the intersection of the first and second die surfaces so as to be arranged to partially form the first bend about the first forming edge and partially form the second bend about the second forming edge;

the second die member being supported for pivotal movement relative to first die member about a second die pivot axis extending substantially along the pivot edge thereof in proximity to an intersection of the first and second forming surfaces from a first position in which the first forming surface and the second forming surface form an obtuse exterior angle therebetween to a second position in which the second forming surface of the second die member is pivotal about the pivot axis against the fourth forming surface of the third die member in the second position of the third die member;

the third die member being supported on the frame for a second movement from the second position thereof to a third position spaced apart from the first die member.

2. The apparatus according to claim 1 further comprising a clamping member supported on the frame so as to be movable relative to the work surface so as to be arranged to clamp the flashing member to the work surface.

3. The apparatus according to claim 2 wherein the clamping member is slidable generally perpendicularly to the work surface between clamping and released positions thereof.

4. The apparatus according to claim 1 wherein the first die member is slidable in a direction of the first forming surface between the engaged position and the released position thereof.

5. The apparatus according to claim 4 wherein the first forming surface is oriented at an upward inclination of approximately 55 degrees from the work surface.

6. The apparatus according to claim 1 wherein the second die member includes a rear surface which intersects the second forming surface at an acute interior angle which defines the pivot edge substantially at the second die pivot axis.

7. The apparatus according to claim 6 wherein said acute interior angle of the second die member is approximately 45 degrees.

8. The apparatus according to claim 6 wherein the second die member is positionable in a first position in which the rear surface is engaged in parallel arrangement against a portion of the first die member which is co-planar with the first forming surface.

9. The apparatus according to claim 1 wherein the second die member is pivotal about the second die pivot axis from a first position in which the second forming surface is transverse to the work surface to a second position in which the second forming surface is engageable in parallel arrangement against the fourth forming surface of the third die member.

10. The apparatus according to claim 9 wherein the second die member is pivotal about the second die pivot axis towards a third position in which the second forming surface is engageable in parallel arrangement against the first forming surface of the first die member.

11. The apparatus according to claim 1 further comprising a carriage assembly supported on the frame and supporting the third die member thereon, the carriage assembly being movable relative to the frame so as to define a first degree of movement of the third die member relative to the frame, and the third die member being movable relative to the carriage assembly so as to define a second degree of movement of the third die member relative to the frame.

12. The apparatus according to claim 11 wherein the carriage assembly is pivotal relative to the frame.

13. The apparatus according to claim 11 wherein the third die member is pivotal about the third die pivot axis relative to the carriage assembly.

14. The apparatus according to claim 1 further comprising an auxiliary forming surface wherein one of the first, second, third and fourth forming surfaces is interchangeable with the auxiliary forming surface and wherein the auxiliary forming surface is different in length than said one of the first, second, third, and fourth forming surfaces.

15. The apparatus according to claim 1 further comprising a first auxiliary forming surface which is interchangeable with the first forming surface and which is different in length than the first forming surface and a second auxiliary forming surface which is interchangeable with the third forming surface and which is different in length than the third forming surface.

16. The apparatus according to claim 1 further comprising:

the second forming surface of the second die member being further pivotal about the pivot axis thereof from the second position of the second die member to a third position of the second die member in which the second forming surface is against the first forming surface when the third die member is in the third position;

the third die member being supported on the frame for a third movement from the third position to return to the second position; and the third die member being supported on the frame for a fourth movement corresponding to a pivotal movement about a pivot axis in proximity to an intersection of the third forming surface and the work surface from the second position to a fourth position in which the third forming surface of the third die member is in close proximity to the work surface.

* * * * *